United States Patent [19]

Bauman

[11] 4,260,497

[45] Apr. 7, 1981

[54] METHANESULFONAMIDES AS ANTISTATIC AGENTS FOR LAUNDERED FABRICS

[75] Inventor: Robert A. Bauman, New Brunswick, N.J.

[73] Assignee: Colgate-Palmolive Company, New York, N.Y.

[21] Appl. No.: 97,580

[22] Filed: Nov. 26, 1979

[51] Int. Cl.[3] ..... C07C 143/74; D06M 13/28; C11D 3/32

[52] U.S. Cl. ..... 252/8.75; 252/8.8; 252/526; 252/530; 252/545; 252/549; 564/98

[58] Field of Search ..... 252/549, 8.8, 545, 8.75, 252/526, 530; 260/556 A

[56] References Cited

U.S. PATENT DOCUMENTS

| | | | |
|---|---|---|---|
| 2,002,613 | 5/1935 | Orthner et al. | 260/556 A |
| 2,658,916 | 10/1953 | Krems | 260/556 A |
| 2,692,235 | 10/1954 | Gebhart et al. | 252/526 |
| 2,692,237 | 10/1954 | Krems | 252/526 |
| 2,721,847 | 10/1955 | Gebhart et al. | 252/545 |
| 2,743,236 | 4/1956 | Morris et al. | 252/117 |
| 2,915,554 | 12/1959 | Ahlbrecht et al. | 260/556 A |
| 3,119,830 | 1/1964 | Burt | 260/556 A |
| 3,586,632 | 6/1971 | Hewitt | 252/117 |
| 3,687,870 | 8/1972 | Muzyczko et al. | 252/545 |
| 3,808,272 | 4/1974 | Kerfort et al. | 260/556 A |

*Primary Examiner*—P. E. Willis, Jr.

*Attorney, Agent, or Firm*—Norman Blumenk; Herbert S. Sylvester; Murray M. Grill

[57] ABSTRACT

Novel methanesulfonamides useful as non-yellowing antistatic agents for laundered fabrics, detergent compositions containing an effective anti-static amount of said methanesulfonamide and a method of protecting fabrics against acquiring static electricity by contacting fabrics with said composition during laundering. These compounds provide antistatic protection without reducing optical brightener performance of the detergent composition.

This invention relates to novel antistatic agents and detergent compositions to be used in the laundering of fabrics containing said antistatic agent which is a nitrogen substituted methansulfonamide having the formula:

$$RNHSO_2CH_3$$

wherein R is a secondary aliphatic hydrocarbon chain of at least 8 carbons.

12 Claims, No Drawings

METHANESULFONAMIDES AS ANTISTATIC AGENTS FOR LAUNDERED FABRICS

DESCRIPTION OF THE PRIOR ART

The use of various and diverse chemical materials and particularly cationic quaternary ammonium compounds as softeners and antistatic agents for textile products is very well known in the art. Is is also well known to employ such materials for their antistatic and softening effects during the laundering operation and particularly in the rinse cycle of the laundering process. This technique has been necessitated by the fact that the aforesaid quaternary compounds theretofore employed, being mainly cationic in nature, were not compatible with the anionic detergents, one of the major types of detergents used in the washing cycle.

It is also well known that there is a tendency for laundered articles to yellow or discolor when treated with aforesaid quaternary compounds.

Another disadvantage associated with the use of said cationic agents in the laundering of fabrics therewith is its interference with the deposition on the fabrics of optical brightener, thereby reducing optical brightener performance of a detergent composition containing said optical brightener.

Still another disadvantage of the cationic quaternary ammonium antistatic softeners is its interference with the cleaning properties of the detergent by reducing the soil removal effected by the detergent, resulting in decreased washing effectiveness. The presence of the anionic detergent material substantially negates the fabric softening properties of the cationic quaternary ammonium compounds as well as counteracts the minimal antistatic activity possessed by said quaternary compounds.

Accordingly, higher alkyl sulfonamides, carboxamides and alkylene oxide reaction products thereof have been found useful in the treatment of fabrics such as in washing compositions, in order to improve detergency efficacy and as softening agents, as disclosed in U.S. Pat. No. 2,002,613 to Orthner et al. Detergent compositions containing higher alkyl sulfonamides to enhance detergency and foaming action is also disclosed in U.S. Pat. No. 2,692,237 to Krems; and specific methods of preparing said alkanesulfonamides from alkane sulfonyl chlorides are disclosed in U.S. Pat. Nos. 3,755,439 to Kennedy and 3,808,272 to Kerfoot et al.

Similarly, higher alkyl aryl sulfonamides have been used in conjuntion with anionic detergents in order to improve soil removal properties of the detergent composition as disclosed in U.S. Pat. Nos. 2,692,235 and 2,721,847 to Gebhart et al, and the preparation of said higher alkyl sulfonamides is disclosed in U.S. Pat. No. 2,658,916 to Krems.

However, none of aforesaid prior art sulfonamides possess antistatic properties.

SUMMARY OF INVENTION

It has now been discovered that the methanesulfonamides of this invention provide antistatic properties and some fabric softening benefits, without causing fabric yellowing, do not interfere with optical brightener action and are compatible with detergents.

Accordingly, it is a primary object of the instant invention to protect fabrics against acquiring staticelectrical charge during machine drying subsequent to laundering.

Another object of the instant invention is to provide such protection in conjunction with conventional detergent compositions during the home laundering process.

A further object of the instant invention is to provide antistatic protection without yellowing and without reducing optical brightener performance.

Still a further object of instant invention is to provide an antistatic composition which may be employed in conjunction with detergents and other cleaning, brightening and laundering additives in a single step laundering operation.

Accordingly, the instant invention relates to antistatic laundering compositions compatible with detergents; and to novel methanesulfonamides represented by the structural formula:

$$RNHSO_2CH_3$$

wherein R is a secondary aliphatic hydrocarbon chain containing at least 8 carbon atoms; and to the process for imparting anti-static properties to fabrics which consists in treating fabrics with a composition containing a methanesulfonamide substituted in the nitrogen by a secondary long chain aliphatic hydrocarbon. More specifically, antistatic properties are imparted to fabrics by laundering the fabrics in a composition containing a detergent, preferably anionic or non-ionic, the above defined methanesulfonamides, and other ingredients such as phosphate or non-phosphate builders, optical brighteners, enzymes, bleaches, and other conventional additives.

The instant novel methanesulfonamides substituted on the nitrogen atom with one secondary long aliphatic chain containing 8–22 carbons reduces or prevents the generation of static electricity on cotton and synthetic fabrics during laundering. These antistatic properties can be imparted to fabrics by laundering in a detergent composition containing said methanesulfonamides which are completely compatible with anionic, non-ionic, cationic and amphoteric detergents. This same treatment has been found to additionally confer a soft hand on cotton fabrics. These beneficial effects are achieved without yellowing or discoloration of the fabrics and without interference with the action of optical brighteners that may be present in the detergent composition.

The methanesulfonamides of instant invention can be prepared from known starting materials by reacting methanesulfonyl chloride with a primary aliphatic amine containing 8–22 carbons wherein the amino functional group is attached to an interior carbon atom of the hydrocarbon chain. Beta amines, manufactured by the Armak Company, which are long chain primary amines, wherein the amino functional group is attached to an interior carbon atom, predominantly at the beta carbon atom, are suitable reactants. Since this reaction is exothermic, cooling is desirable in order to maintain the temperature below 30° C. The reaction is preferably conducted in the presence of any non-reactive organic solvent such as methylene chloride, methyl or ethyl ether, benzene, chloroform or the like, and in the presence of any tertiary amine such as trimethyl amine, pyridine and preferably triethylamine which reacts with the acid byproduct formed during this reaction. The reaction mixture is preferably washed successively with water, 14% ammonia and water, and dried over $Na_2$-

$SO_4$ or similar neutral salt. The solvent is removed, preferably by evaporating in vacuum. The resultant methanesulfonamides, which are usually made from mixtures of amines, are liquids, oils or solids.

The following examples illustrate the manner in which compounds of this invention are prepared, but is not limited thereto.

EXAMPLE 1

Preparation of N-(6-Undecyl)methanesulfonamide: $(C_5H_{11})_2CHNHSO_2CH_3$

To a solution of 10 g 6-aminoundecane and 6 g triethylamine in 100 ml methylene chloride was added 7 g methanesulfonyl chloride with cooling and stirring over a period of 10 minutes. After an additional hour of stirring at room temperature, the reaction mixture was permitted to stand over night. It was then transferred to a separatory funnel, washed with water three times dried over $Na_2SO_4$, evaporated to 11 g of an oil, and stirred with 20 ml of concentrated ammonium hydroxide for 15 minutes. Ether was added to separate out the sulfonamide which was dried, yielding 9 g of an oil free of the acid chloride smell.

EXAMPLE 2

Preparation of N-(2-Tridecyl)methanesulfonamide:

$$C_{11}H_{23}\underset{\underset{CH_3}{|}}{C}HNHSO_2CH_3$$

To a solution of 10 g (50 mmol) 2-aminotridecane and 5 g triethylamine in 100 ml methylene chloride is added 6 g methanesulfonyl chloride while cooling and stirring for a period of 10 minutes. After one hour of additional stirring, it was allowed to stand over night. The reaction mixture was subsequently transferred to a separatory funnel, washed three times with water, dried over $Na_2$ $SO_4$, evaporated to a white solid and dried in a vacuum oven.

EXAMPLE 3

Preparation of the methanesulfonamide of the beta amine, $$CH_3(CH_2)_{12-17}\underset{\underset{NH_2}{|}}{C}HCH_3 \quad : \quad CH_3(CH_2)_{12-17}-\underset{\underset{CH_3}{|}}{C}HNHSO_2CH_3$$

To a solution of 28 g (83 mmol) of said beta amine (Armeen L-15 from the Armak Company) and 13 ml triethyl amine (94 mm) in 150 ml methylene chloride was slowly added 7 ml (10.5 g, 90 mm) methanesulfonyl chloride. This sulfonamide was prepared in accordance with the procedure of Example 1.

EXAMPLE 4

Preparation of the methanesulfonamide of the beta amine, $$CH_3(CH_2)_{8-11}\underset{\underset{CH_3}{|}}{C}HNH_2 \quad :$$

-continued $$CH_3(CH_2)_{8-11}\underset{\underset{CH_3}{|}}{C}HNHSO_2CH_3$$

To a solution of 19 g of above beta amine (Armeen L-11 from the Armak Company) and 13 ml triethyl amine in 150 ml methylene chloride was slowly added 7 ml (10.5 g) methanesulfonyl chloride and the sulfonamide was isolated in accordance with the procedure of Example 1.

The process described in the above examples may be varied by using other non-reactive organic solvents such as ether, benzene, chloroform, etc.; other tertiary amines to react with the acid byproduct such as trimethylamine, pyridine and the like.

Other long chain aliphatic primary amines wherein the amino functional group is attached to any inner carbon atom may be used in the preparation of instant methanesulfonamide anti-static agents, such as octyl, nonyl, decyl, dodecyl, tetradecyl, hexadecyl, heptadecyl, octadecyl, nonadecyl amine, etc. and mixtures thereof.

Primary amines where the amino group is attached to the terminal carbons, such as dodecylamine, hexadecylamine, octadecylamine and the like yield methanesulfonamides with very limited effect on static.

Accordingly, it has been found that the substituents on the nitrogen atom of the methanesulfonamides effective as antistatic agents are selected from the group consisting of a secondary long aliphatic chain containing 8–22 carbons.

The antistatic compounds of this invention may be used in conjunction with detergents which include anionic detergents such as alkylbenzene-sulfonic acid and its salts, e.g. compounds of the formula alkyl-phenyl-$SO_3$-M, wherein alkyl is an alkyl radical of $C_8$ to $C_{22}$ and preferably $C_{10}$ to $C_{18}$ and M is hydrogen or an alkali metal, which compounds comprise a well-known class of anionic detergents and include sodium dodecylbenzene sulfonate, potassium dodecylbenzenesulfonate, sodium laurylbenzenesulfonate, sodium cetylbenzenesulfonate. Others include paraffin sulfonates, alkyl sulfates, alcohol ether sulfates, olefin sulfonates and the alkylphenolethoxylate sulfates (e.g., sodium dinonylphenoxynonaethoxyethanol sulfate, sodium dodecylhexadecaethoxyethanol sulfate), and other equivalent water-soluble salts, particularly of the alkali metal series.

Among the above-noted alkylbenzene-sulfonic acid and salts thereof, the preferred compounds include those which are biodegradable and which are particularly characterized by a linear alkyl substituent of from $C_{10}$ to $C_{22}$ and preferably from $C_{12}$ to $C_{15}$. It is, of course, understood that the carbon chain length represents, in general, an average chain length since the method for producing such products usually employs alkylating reagents of mixed chain length. It is clear, however, that substantially pure olefins as well as alkylating compounds used in other techniques can and do give alkylated benzene sulfonates wherein the alkyl moiety is substantially (i.e., at least 99%) of one chain length, i.e., $C_{12}$, $C_{13}$, $C_{14}$, or $C_{15}$. The linear alkyl benzene sulfonates are further characterized by the position of the benzene ring in the linear alkyl chain, with any of the position isomers (i.e., alpha to omega) being operable and contemplated.

In addition to the benzene sulfonates one may also employ the lower alkyl ($C_1$ to $C_4$)analogs of benzene such as toluene, xylene, the trimethyl benzenes, ethyl benzene, isopropyl benzene and the like. The sulfonates are generally employed in the water soluble salt form which include as the cation, the alkali metals, ammonium and lower amine, and alkanolamine cations.

Examples of suitable linear alkyl benzene sulfonates include:

sodium n-decyl benzene sulfonate
sodium n-dodecyl benzene sulfonate
sodium n-tetradecyl benzene sulfonate
sodium n-pentadecyl benzene sulfonate
sodium n-hexadecyl benzene sulfonate and the corresponding lower alkyl substituted homologues of benxene as well as the salts of the cations previously referred to. Mixtures of these sulfonates may, of course, also be used with mixtures which may include compounds wherein the linear alkyl chain is smaller or larger than indicated herein provided that the average chain length in the mixture conforms to the specific requirements of $C_{10}$ to $C_{22}$.

The linear paraffin sulfonates are also a well-known group of compounds and include water-soluble salts (alkali metal, amine, alkanolamine, and ammonium) of:

1-decane sulfonic acid
1-dodecane sulfonic acid
1-tridecane sulfonic acid
1-tetradecane sulfonic acid
1-pentadecane sulfonic acid
1-hexadecane sulfonic acid as well as the other position isomers of the sulfonic acid group.

In addition to the paraffin sulfonates illustrated above, others with the general range of $C_{10}$ to $C_{22}$ alkyls may be used, with the most preferable range being from $C_{12}$ to $C_{20}$.

The linear alkyl sulfates which are contemplated in this invention comprise the range of $C_{10}$ to $C_{20}$. Specific examples include sodium n-decyl sulfate; sodium n-dodecyl sulfate; sodium n-hexadecyl sulfate; sodium n-heptadecyl sulfate; sodium n-octadecyl sulfate; and the ethoxylated (1 to 100 moles ethylene oxide) derivatives; and, of course, the other water-soluble salt-forming cations mentioned above.

Included in the group of anionic detergents, which have been described above as suitable in the present invention, are the olefin sulfates, including long chain alkene sulfonates, long chain hydroxyalkane sulfonates, as well as disulfonates. Examples of suitable olefin sulfonates, which are merely illustrative of the general class, are sodium dodecenyl-1 sulfonate, sodium tetradecenyl-1 sulfonate, sodium hexadecenyl-1 sulfonate, and sodium octadecenyl-1 sulfonate.

Also useful in conjunction with instant antistatic methanesulfonamides are non-ionic detergents which are commercially known such as alkylaryl polyglycol detergents such as alkyl-phenol-alkylene oxide and preferably ethylene oxide condensates (2–200 moles ethylene oxide), e.g., p-isooctyl phenol-polyethylene oxide (10 ethylene oxide units), long chain alcohol-ethylene oxide condensation products (2–200 moles ethylene oxide), e.g., dodecyl alcohol-polyethylene ozides having 4 to 16 ethylene oxide units per molecule, polyglycerol monolaurate, glycol dioleate, sorbitan monolaurate, sorbitan monostearate, sorbitan monopalmitate, sorbitan monooleate, sorbitan sesquioleate, the condensation products of ethylene oxide with sorbitan esters of long chain fatty acids (Tweens), alkylolamides, amine oxides, phosphine oxides, etc.

In addition to the anionic and nonionic detergents which may be employed in conjunction with the antistatic agents of instant invention, cationic, ampholytic, and zwitterionic compounds have also been found to be useful. Representative of those compounds which may be employed in conjunction with the instant fabric antistatic compounds include quaternary ammonium compounds, e.g., distearyl dimethyl ammonium chloride, cetyl trimethyl ammonium bromide, sodium 3-dodecylamino propionate, fatty carbamides, etc.

The composition of the instant invention may also include, in addition to instant antistatic compounds and conventional anionic, cationic, and nonionic detergents, builders, brighteners, hydrotropes, germicides, soil suspending agents, anti-redisposition agents, antioxidants, bleaches, coloring materials (dyes and pigments), perfumes, water-soluble alcohols, foam boosters, non-detergent alkali metal benzene sulfonates, etc.

The builder is, generally, a water-soluble, inorganic salt which may be a neutral salt, e.g., sodium sulfate or an phosphates and pyrophosphates and alkali citrates. Specific examples of alkaline salts are: tetrasodium pyrophosphate, pentasodium tripolyphosphate (either Phase I or Phase II), sodium hexametaphosphate, and the corresponding potassium salts of these compounds, sodium and potassium silicates, e.g., sodium metasilicate and other silicates (e.g., $Na_2O$; 1.6–3$SiO_2$), sodium carbonate, potassium carbonate and sodium and potassium becarbonate, sodium citrate and potassium citrate. Other salts may also be used wherein the compounds are water-soluble including the general class of alkali metals, alkaline earth metals, amine, alkanolamine, and ammonium salts. Other builders which are salts of organic acids may also be used, and in particular the water-soluble (alkali metal, ammonium substituted ammonium and amine) salts of aminopolycarboxylic acids such as:

ethylene diamine tetra-acetic acid
nitrilo triacetic acid
diethylene triamine pentaacetic acid
N-(2-hydroxyethyl)-ethylene diamine triacetic acid
2-hydroxyethyl-iminodiacetic acid
1,2-diaminocyclohexane diacetic acid and the like. Water-insoluble builders having cation-exchange properties may be used also, such as the sodium aluminosilicates, for example Zeolite A, which may be used alone or in combination with other builders such as sodium tripolyphosphate.

In addition to the above ingredients one may as previously delineated employ hydrotropes in connection with the composition of the instant invention. The useful hydrotropes include such compounds as sodium xylene sulfonate, potassium xylene sulfonate, sodium and potassium toluene sulfonates, and the position isomers thereof, ethyl benzene sulfonate, cumene sulfonates, and the like.

In addition to compositions comprising the novel methanesulfonamide antistatic agents of the instant invention in combination with detergent and conventional laundering additives, it is noted that said antistatic agents may in addition be formulated in suitable vehicles for addition to the laundering cycle with the concomitant addition of detergent materials. In connection therewith said sulfonamide may be solubilized and/or dispersed by conventional techniques utilizing alcohols, ether alcohols, hydrotropic solutions, glycols, and the like. Furthermore, it is noted that said antistatic agents may also be absorbed onto suitable salts and/or other carriers for addition to the laundering cycle such as, for example, phosphates, borax, silicates, sodium sulfate, clays, starch, and the like.

The amount of methanesulfonamide utilized in connection with detergent compositions is generally considered to be a relatively small proportion as compared to the weight of the active ingredients therein. It is noted, however, that one need only employ an effective amount of said sulfonamide which in fact produces the desired antistatic action on fabrics. It is preferred that said amide be present in an amount of from about 2% to about 25%, and preferably 5% to 20%, of the total ingredients present in the detergent composition on a weight basis.

The composition of the instant invention may be employed in either particulate, liquid, tablet, or any other conventional form. Moreover, as noted above, the novel methanesulfonamides as disclosed herein may be employed as antistatic fabric agents by being applied to textile materials during the washing process, with the concomitant addition of detergent materials thereto.

The laundering composition of instant invention will now be illustrated by the following more detailed examples thereof. It is noted, however, that these compositions are merely illustrative and it is not limited thereto.

EXAMPLE 5 a, b, c

Non-phosphate anionic detergent

| Ingredient | % |
|---|---|
| Sodium Dodecyl benzenesulfonate | 23 |
| Sodium carbonate | 20 |
| Sodium silicate (1:2.4) | 15 |
| Soap (Sodium Coco-Tallow 80:20) | 2 |
| Nonionic detergent* | 1 |
| Borax | 3 |
| Sodium carboxymethylcellulose | 1 |
| Optical Brightener | .5 |
| Calcined aluminum silicate | 1 |
| Sodium sulfate | 30.5 |
| Water | 3 |
| | 100.0 |

*Fatty alcohol ($C_{14-15}$) with average of 11 moles ethylene oxide.

This composition is spray-dried to produce a powder. To 100 g of this formulation is added 2–10 g methanesulfonamide antistatic agent:

$$CH_3(CH_2)_{8-11}\underset{\underset{CH_3}{|}}{C}HNHSO_2CH_3 \quad \text{a.}$$

$$CH_3(CH_2)_{12-17}\underset{\underset{CH_3}{|}}{C}HNHSO_2CH_3 \quad \text{b.}$$

N-(6-Undecyl) methanesulfonamide c.

EXAMPLES 6 a, b, c

Phosphate-built Anionic Detergent

| Ingredient | % |
|---|---|
| Sodium Tridecyl benzenesulfonate | 15 |
| Nonionic detergent* | .5 |
| Sodium silicate (1:2.4) | 10.5 |
| Sodium tripolyphosphate | 33 |
| Sodium carbonate | 5 |
| Sodium sulfate | 24 |
| Sodium Carboxymethylcellulose | .25 |

-continued

| Ingredient | % |
|---|---|
| Optical Brighteners | .5 |
| Borax | 1.0 |
| Perfume | .15 |
| Water | 10.1 |
| | 100.0 |

*Fatty alcohol ($C_{12-15}$) condensed with average of 7 moles ethylene oxide.

This composition is also spray-dried to produce a powder.

To this composition is added 2–10 g of the methanesulfonamide antistatic agent:

$$CH_3(CH_2)_{8-11}\underset{\underset{CH_3}{|}}{C}HNHSO_2CH_3 \quad \text{a.}$$

$$CH_3(CH_2)_{12-17}\underset{\underset{CH_3}{|}}{C}HNHSO_2CH_3 \quad \text{b.}$$

N-(6-Undecyl) methanesulfonamide. c.

EXAMPLE 7 a, b, c

Built Nonionic Detergent

| Ingredient | % |
|---|---|
| Ethoxylated alcohol* | 19 |
| Sodium tripolyphosphate | 60 |
| Sodium silicate (1:2.4) | 10 |
| Optical Brighteners | 2 |
| Enzyme (Proteolytic) | 1.5 |
| Perfume and Color | 0.35 |
| Moisture | 7.15 |
| | 100.00 |

*Fatty alcohol ($C_{12-13}$) condensed with an average of 6.5 moles ethylene oxide.

To 40 g of this formulation which is in the form of a powder, is added 2–10 g of fabric antistatic agent:

$$CH_3(CH_2)_{8-11}\underset{\underset{CH_3}{|}}{C}HNHSO_2CH_3 \quad \text{a.}$$

$$CH_3(CH_2)_{12-17}\underset{\underset{CH_3}{|}}{C}HNHSO_2CH_3 \quad \text{b.}$$

N-(6-Undecyl) methanesulfonamide. c.

Utility of the methanesulfonamides in reducing static electricity without yellowing or depressing brightening was shown in a test run in GE washers (18 gal. water) at 120° F. with a mixed fabric load (cotton terry, dacron double knit, Banlon nylon, dacron/cotton 65/35), and tumble dried for 45 minutes. In each case 3 g of the test material was added to the washer simultaneously with 40 g of the formulation of Example 7.

TABLE I

| Methanesulfonamide of | Static Value(1) | Brightness(2) | Whiteness(3) | Softness(4) |
|---|---|---|---|---|
| | (of 86% Cotton Terry Towels) | | | |
| 1. None | 12.7 kV | 400 | −5.1 | 1 |
| 2. $CH_3(CH_2)_{8-11}\underset{\underset{CH_3}{\mid}}{C}HNH_2$ | .5 | 431 | −6.2 | 1 |
| 3. $CH_3(CH_2)_{12-17}\underset{\underset{CH_3}{\mid}}{C}HNH_2$ | 2.0 | 438 | −6.2 | 6 |
| 4. 6-Undecylamine | 2.9 | 440 | −6.5 | 3 |

(1) Sum of the absolute values of surface charges of the four fabrics on removal from the dryer.
(2) Measured on Colorgard XL70 Large Area Color Difference Meter; higher values are brighter.
(3) ON -b scale larger negative values are whiter.
(4) Subjective rating on a scale of 1 to 10; higher values are softer.

Comparative results with methanesulfonamides, not embraced by instant invention, show their inability to reduce static electricity generated during the washing and drying of mixed fabric loads.

In Table II are the results of similar tests run with dry mixtures of 5 g of sulfonamide with 40 g of the built non-ionic detergent of Example 7 or with 5 g of sulfonamide in 100 g of the phosphate anionic detergent of Example 6. The fabric load consisting of 14 sq. in. swatches of cotton terry towel. dacron, nylon and dacron/cotton 65/35 was washed in a Whirlpool washer (66 liter capacity) at 120° F. wash/cold rinse and tumble dried 45 minutes in a Westinghouse dryer.

TABLE II

| Composition | Methanesulfonamide | Static value | Amount sulfonamide adsorbed on dacron (mg)[3] |
|---|---|---|---|
| 1. Example 7 | — | 29.9 kV | 0 |
| 2. Example 6 | — | 33.7 | 0 |
| 3. Example 7 | $C_{18}H_{37}NHSO_2CH_3$ (t.s.)[1] | 15.4 | 33 |
| 4. Example 6 | $C_{18}H_{37}NHSO_2CH_3$ (t.s.) | 38.0 | 45 |
| 5. Example 7 | $C_{12}H_{25}NHSO_2CH_3$ (t.s.) | 12.0 | 24 |
| 6. Example 6 | $C_{12}H_{25}NHSO_2CH_3$ (t.s.) | 12.8 | 13 |
| 7. Example 7 | methanesulfonamide of Armeen L-15 (i.s.)[2] | 1.3 | 495 |
| 8. Example 6 | methanesulfonamide of Armeen L-15 (i.s.) | 1.55 | 363 |

[1]terminally substituted.
[2]internally substituted.
[3]The dacron swatches from each run were extracted with hexane for 2 hours. The extracts were evaporated and the residue weighed in mg. The amount of sulfonamide actually adsorbed by the dacron from the wash solution is the difference between the residue weight and the blank (Example 1 and 2 wherein no sulfonamide was added). Further extraction of the swatches with ethyl ether gave no increase in weight of extract.

The instrumental readings as to whiteness and brightness were omitted herein, because there was no significant yellowing or brightness loss with these combinations, as similarly shown with the compositions in Table I. However, the ability of the internally substituted sulfonamides to reduce static electricity is clearly whown by Examples 7 and 8, whereas the terminally substituted sulfonamides' ability to reduce static electricity is minimal as shown by Examples 3 to 6.

Another property possessed by the internally substituted sulfonamides is their ability to be strongly adsorbed by polyester fabrics, whereas terminally substituted sulfonamides are not capable of being readily adsorbed by said fabrics.

EXAMPLE 8

| A heavy-duty liquid detergent is formulated as follows: | |
|---|---|
| Linear dodecyl benzene sulfonate | 10% |
| Sodium cumene sulfonate | 10% |
| N-(2-Tridecyl)methanesulfonamide | 5% |
| Potassium pyrophosphate | 15% |
| Water quantity sufficient to make 100% | |

The above formulation results in a liquid composition which when employed in the usual manner in laundering operations results in the suppression of the generation of static on said laundered fabrics.

EXAMPLE 9

Example 8 is repeated with the exception that the potassium pyrophosphate is replaced by 20% sodium nitrilo triacetate. The results obtained therefrom are excellent insofar as the antistatic rating is concerned.

In connection with the subject compositions, it is noted that in built detergents, the organic cleaning agent, i.e., the anionic, nonionic, etc., compound may comprise from about 5% to upwards of 75% by weight of the total formulation and usually varies from 5% to 35% by weight. In liquid compositions, the amount of water used is relatively high in order to obtain pourable and generally stable systems. In these, total solids may vary from a few percent, i.e., 2–10%, upwards of about 50–60% with the organic detergent present, usually in amounts from about 2–25% and preferably 5–15%. In solid formulation, i.e., powder, etc., total solids may run as high as 90% or more and here the organic detergent may be used at the high concentrations above indicated, but usually the range is 5–25%. The second major component of the built or heavy duty liquids, and this is true of the solid (i.e., powdered or tableted types) formulations also, is the alkaline builder salt, and the amount thereof again may vary considerably, e.g., from 5–75% of the total composition. In solid formulations, larger percentages are generally employed, e.g., 15–50%, whereas in the liquid types, the salts are used in lesser amounts, e.g., 5–25% by weight of the total composition.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. Methanesulfonamide antistatic agents substituted on the nitrogen atom and having the formula:

$$RNHSO_2CH_3$$

wherein R is a secondary aliphatic hydrocarbon chain containing at least 8 carbons.

2. A compound in accordance with claim 1, wherein the secondary aliphatic chain contains 8–22 carbons.

3. A compound in accordance with claim 2, which has the formula:

$$(C_5H_{11})_2CHNHSO_2CH_3.$$

4. A compound in accordance with claim 2, which has the formula:

$$CH_3(CH_2)_{12-17}\underset{\underset{CH_3}{|}}{C}HNHSO_2CH_3 \quad .$$

5. A non-yellowing antistatic composition for laundering fabrics comprising an effective antistatic amount of the methanesulfonamide antistatic agent defined in claim 1, and a detergent selected from the group consisting of anionic, nonionic, cationic, ampholytic and zwitterionic detergent materials.

6. A non-yellowing antistatic composition for laundering fabrics comprising about 2–25% by weight of the methanesulfonamide antistatic agent defined in claim 1, and a nonionic detergent.

7. The composition of claim 6, additionally comprising optical brighteners and builders.

8. The composition of claim 5, wherein the detergent is anionic and the antistatic agent constitutes about 2–25% by weight of the composition.

9. The composition of claim 8, additionally comprising optical brighteners and builders.

10. A method of protecting fabrics against acquiring static electricity during the laundering process comprising contacting fabrics with a composition containing a methanesulfonamide antistatic agent having the formula $RNHSO_2CH_3$, wherein R is a secondary aliphatic hydrocarbon chain containing at least 8 carbons.

11. A process of imparting antistatic properties to fabrics which consists in treating fabrics with a composition containing an antistatic amount of a methanesulfonamide having the formula $RNHSO_2CH_3$, wherein R is a secondary aliphatic hydrocarbon chain containing at least 8 carbons.

12. The method of claim 11, which consists in laundering the fabrics in a composition comprising a detergent and the methanesulfonamide antistatic agent.

* * * * *